United States Patent [19]

Hackmack

[11] Patent Number: 4,861,199

[45] Date of Patent: Aug. 29, 1989

[54] SLIT TRENCHER

[76] Inventor: Alfred Hackmack, Am Deich 30, D-2095 Obermarschacht, Fed. Rep. of Germany

[21] Appl. No.: 2,963

[22] Filed: Jan. 13, 1987

[30] Foreign Application Priority Data

Jan. 11, 1986 [DE] Fed. Rep. of Germany ..... 3600663
Jan. 16, 1986 [DE] Fed. Rep. of Germany ..... 3601039
Oct. 19, 1986 [DE] Fed. Rep. of Germany ..... 3638555

[51] Int. Cl.[4] ..... E02F 5/06; E02F 3/14

[52] U.S. Cl. ..... 405/267; 37/86; 37/191 A; 405/270

[58] Field of Search ..... 37/83, 94, 86, 87–90, 37/189, 191 A, 192 A; 405/267, 268, 270; 172/699, 720–725, 730–733

[56] References Cited

U.S. PATENT DOCUMENTS

| | | | |
|---|---|---|---|
| 2,335,166 | 11/1943 | Wilson | 37/83 |
| 3,603,010 | 9/1971 | Polinek | 37/83 |
| 3,646,767 | 3/1972 | Shelley | 405/268 X |
| 3,659,364 | 5/1972 | Wilson | 37/83 |
| 3,676,941 | 7/1972 | Cohrs et al. | 37/83 X |
| 3,831,299 | 8/1974 | Kelley | 37/193 X |

FOREIGN PATENT DOCUMENTS

| | | | |
|---|---|---|---|
| 294072 | 4/1965 | Netherlands | 37/83 |
| 241300 | 3/1970 | U.S.S.R. | 37/83 |

*Primary Examiner*—Edgar S. Burr
*Assistant Examiner*—Moshe L. Cohen
*Attorney, Agent, or Firm*—Thomas L. Adams

[57] ABSTRACT

A slit trencher can be mounted on a carrier machine which moves in a driving direction. The trencher includes a holder adapted to be mounted on the carrier machine. Also included is a boom mounted on this holder. The trencher has a circulating chain and a plurality of slit formers mounted on the circulating chain. The circulating chain mounted on the boom circulates thereon. This circulating chain is operable to perform work when circulating along a running direction. Each of the slit formers has a cutting edge slanted both with respect to the running direction of the chain and with respect to the driving direction of the carrier machine. These slit formers have a rear side and each includes a cover plate and a rear plate. The cover plate has a horizontal width sized to cover the width of the slit. This cover plate is slanted towards a direction opposite to the running direction of the circulator. The rear plate is mounted adjacent to the cover plate to block the rear side.

18 Claims, 3 Drawing Sheets

SLIT TRENCHER

BACKGROUND OF THE INVENTION

This invention relates to a slit trencher and a method for forming a relatively narrow slit.

When making foundations in walls for sealing against water, slit trenches are often needed. Such slit trenches can be made by trenchers, back hoes, and excavators if the depths of the slits are not too deep and they made by slit grabs if they are deeper. Bauer of Schrobenhausen, West Germany, made a slit trencher by placing an auger on the mast of a rammer mounted on an excavator.

The disadvantages of these known machines are: either the speed is slow if excavators, back hoe loaders, and grabs are used; or if trenchers are used, it is not possible to dig vertically because known trenchers employing cutters all work with inclination. Consequently, at the beginning and end of a foundation trench an inclination is left.

Trenchers cannot be used for slits at all if the slits are rather narrow and deep. Known trenchers with small buckets on a chain which can work vertically have a disadvantage that the buckets cannot be emptied if they are working in clayish soil, especially if the buckets are very narrow.

SUMMARY OF THE INVENTION

In accordance with the illustrative embodiments demonstrating features and advantages of the present invention, there is provided a slit trencher for mounting on a carrier machine which moves in a driving direction. The trencher has a holding means adapted to be mounted on the carrier machine and a boom mounted on the holding means. The trencher also includes a circulating means mounted on the boom to circulate thereon. This circulating means is operable to work when circulating along a running direction. The trencher also includes a plurality of slit formers mounted on the circulating means. Each of the slit formers has a cutting edge slanted both with respect to the running direction of the circulating means and with respect to the driving direction of the carrier machine. The slit formers each have a rear side and each include a cover plate and a rear plate. The cover plate has a horizontal width sized to cover the width of the slit. This cover plate is slanted towards a direction opposite to the running direction of the circulating means. The rear plate is mounted adjacent to the cover plate to block the rear side.

According to the principles of the same invention the foregoing slit trencher has a slit former, a wedge-shaped displacing tool. The tool has a cutting edge perpendicular to the running direction of the circulating means. A pair of sides diverge laterally from the cutting edge in a direction opposite to said running direction. The slit formers are positioned and aligned to displace soil to either side of the slit.

According to a related method according to the same invention, a slit is formed in a driving direction with a slit former having a cutting edge. The method includes the step of circulating the slit former in a closed circuit to periodically move the slit former in a running direction. The cutting edge is slanted with respect to both the running and driving directions. Another step in the method is lowering the closed circuit substantially vertically to bring the slit former to a predetermined slit depth. Another step is moving the closed circuit a predetermined distance in the driving direction to lengthen the slit. Another step in the method is elevating the closed circuit substantially vertically.

Accordingly, use of the foregoing apparatus and method can allow one to make narrow and deep slits relatively inexpensively and in such a way that both ends of the trench are vertical. In a preferred embodiment, a boom is mounted on a carrier machine with a chain circulating around it in a vertical loop. Mounted on the chain are a spaced plurality of slit cutters. Cutters can have a plow-like shape or chisel-like shape.

For example, the cutting edge of the slit cutter can be slanted to the running direction of the chain and the driving direction of the carrier machine. A rear plate can be fixed onto the chain to close the back and prevent excavated soil from falling behind the chain. The slit cutter proper can have a cover plate existing between the cutting edge and the rear plate. This cover plate covers the width of the slit so that no soil can fall downwards and therefore all soil will be transported upwardly. Preferably the cover plate is inclined either to one, to two, or to three sides. By this inclination, soil falls to the right, to the left, in front, or to all three directions after the cutters have left the slit. In this arrangement cutters are open on one, two, or three sides. Therefore, the transported soil can be emptied even if it is sticky soil such as clay.

Consequently, the invention can offer advantages over backhoe loaders, excavators, and slit grabs. Slit trenchers according to the present invention can be faster and work more efficiently and at lower expense to dig narrower trenches deeper. In contrast to the auger, the slit can be made much narrower and, in comparison to normal trenchers, the present machine can cut vertically with no inclination at the beginning and the end. Also there is no difficulty if the machine has to be lifted over interfering pipes; still facilitating the cutting of narrower and deeper slits.

The preferred slit trencher, built according to the principles of this present invention, can cut a slit 7 cm wide and 4 meters deep. These slits can be for plastic seal breadths for keeping off water. These 4 cm wide slits can also be used for trench lining steels, a feat not performable by known slit trenchers.

BRIEF DESCRIPTION OF THE DRAWING

The above brief description as well as other features and advantages of the present invention will be more fully appreciated by reference to the following detailed description of a presently preferred but nonetheless illustrative embodiment in accordance with the present invention when taken in conjunction with the accompanying drawings, wherein.

DETAILED DESCRIPTION OF THE PREFERRED EMBODIMENT

Figure 1:
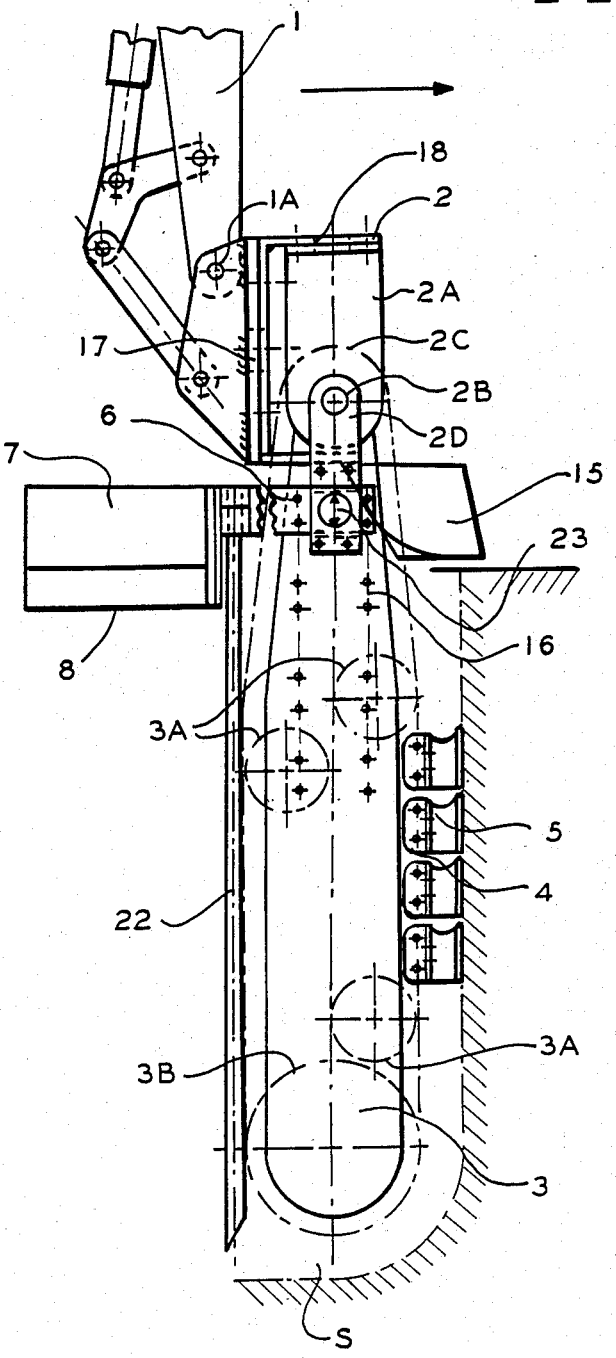
FIG. 1 is a side view of the slit trencher employed as an attachment for excavators, according to the principles of the present invention.

Referring to FIG. 1, a slit trencher is shown mounted on boom 1 of an excavator (not shown) by a holding device 2. The excavator could also be a trencher, backhoe, or similar equipment. Holding device 2 is a C-shaped frame into which is rotably secured a support 2A. Journalled in support 2A is a shaft 2B which supports a drive sprocket 2C. Support 2A is affixed to boom 3 which is an elongate plate extending generally downward. Boom 3 has a number of idler sprockets 3A rotatably attached to it for the purposes described hereinafter.

A circulating means is shown herein as chain 4 which has attached to its links a plurality of slit formers 5 described presently. A larger idler sprocket 3B is journaled on the lower end of boom 3. Chain 4 is wrapped in a circuit around sprockets 2C, 3A, and 3B. Accordingly, a motor, such as a hydraulic motor (not shown), may be applied to drive shaft 2B to turn sprocket 2C and circulate chain 4 in a counterclockwise direction (this view).

A holding bracket 6 is bolted to the boom 3 to support a dozer blade 15 in the shape of a plow. Mounted on the rear of holding bracket 6 is a guide 7 in the form of a U-shaped bracket with guide plates 8 having a width designed to allow placement of steel liners. The holding bracket 6 can be bolted to any one of a number of illustrated holes 16 in boom 3 to set the depth of penetration of the apparatus of FIG. 1.

Between boom 1 of the carrier machine and the boom 3 is a tilting device 17 and a rotating 18 device. The entire assembly can roll about a horizontal axis by means of the pivot point at the juncture at frame 17.

Secured to bracket 6 in a generally upright orientation is a pipe 22, mounted behind boom 3. Pipe 22 fits within slit S and may be used to inject concrete or other material. Instead of this pipe, there can be mounted in its place a device for putting trench linings into slit S with guide plate 7 and 8.

Figure 2:
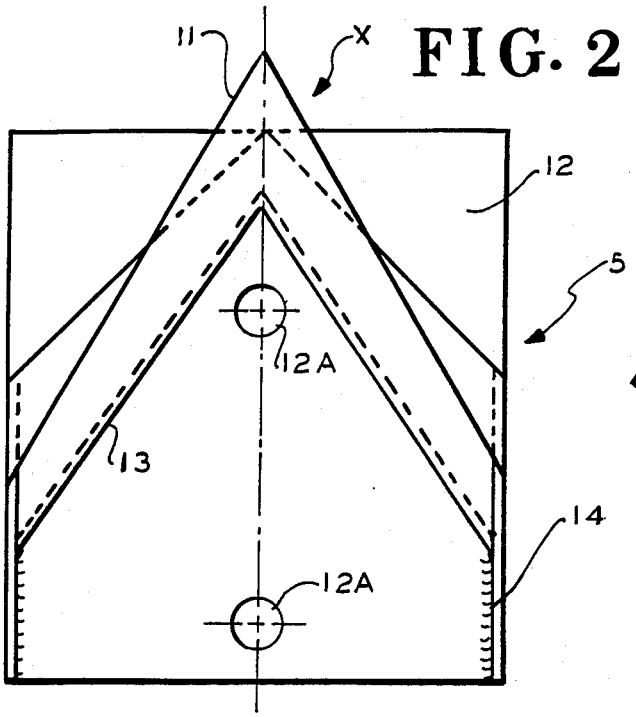
FIG. 2 is a top view of a slit cutter which may be used in the apparatus of FIG. 1 and which causes the soil to fall away from both sides.
Figure 3:
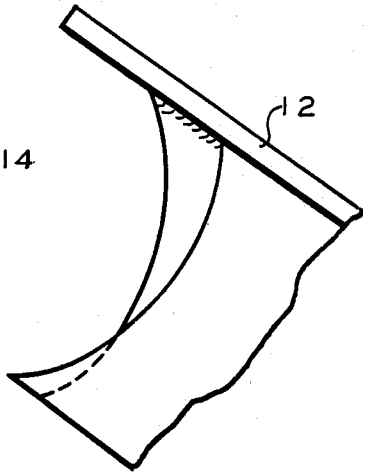
FIG. 3 is a side view of the slit cutter of FIG. 2 taken from direction X as shown in FIG. 2.

Referring to FIGS. 2 and 3, the slit cutter 5 is shown composed of a upright rear plate 12 having attachment holes 12A. The cutting edge 11 of the slit cutter 5 is slanted to the direction of travel of the chain as well as the driving direction of the carrier machine. The rear plate 12 can be fixed to the chain (chain 4, FIG. 1) to prevent excavated soil from falling behind the chain. The cutting edge 11 is formed from a cover plate 13. Plate 13 has a right and left portion, each of which is bowed inwardly to appear concave from above. The center line of cover plate 13 forms a peak which is a concave intersection of the right and left halves. Plate 13 is somewhat saddle-shaped but with a sharp peak running fore and aft. Plate 13 covers the slit toward the bottom and prevents excavated soil from falling down into the slit and instead allows it to be transported upwardly. The right and left portions of plate 13 are seen to slant downwardly, that is in a direction opposite to the run of the chain (chain 4 in FIG. 1). Guide plates 14 are located on opposite edges of plate 12 at the end of cover plate 13. It will be seen that the cutting edge 11 may be deemed to have two edges; one inclined downwardly in a fore-to-aft direction, and one athwart. Therefore, the cutting edge is slanted with respect to both the direction of travel of the chain as well as the driving direction of the carrier machine. Being configured as shown in FIG. 2, the slit cutter can cause soil to be driven rearwardly where it piles up before being cast to the side when the slit is exited.

Figure 4:
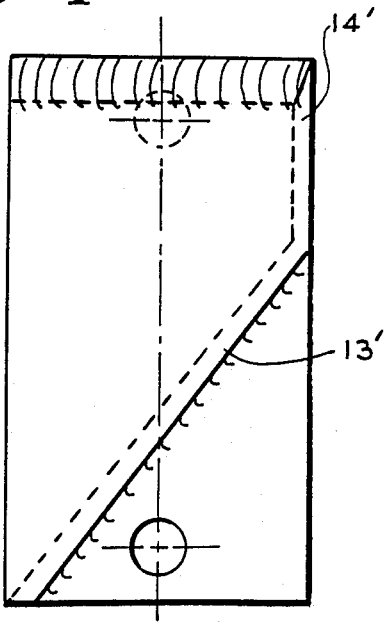
FIG. 4 is a front view of a slit cutter which is an alternate to that of FIG. 2 in which soil falls away only on one side.
Figure 5:
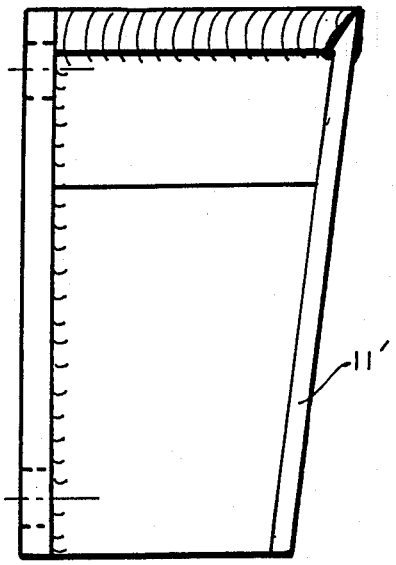
FIG. 5 is a side view of the cutter of FIG. 4.
Figure 6:
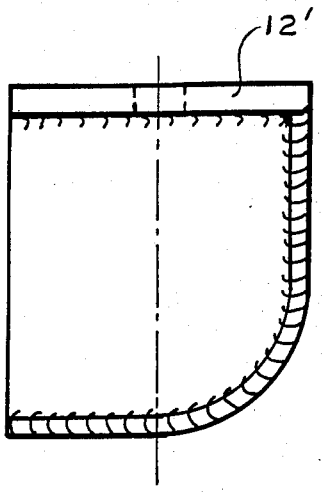
FIG. 6 is a top view of the cutter of FIG. 4.

Referring to FIGS. 4, 5, and 6, an alternate slit cutter is shown having a similar rear plate 12'. This cutter has a cover plate 13' which has a segment that is slanted downwardly to the left (as viewed in FIG. 4). Atop cover plate segment 13' is a guide plate segment 14' rising vertically therefrom. On the front of cover plate 13' there is an upright cutting edge 11' which is tilted to have its upper edge in an advanced position.

Figure 9:
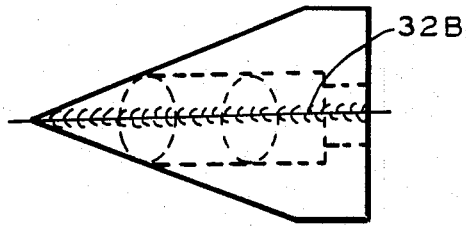
FIG. 9 is a bottom view of the slit cutter of FIG. 7.
Figure 7:
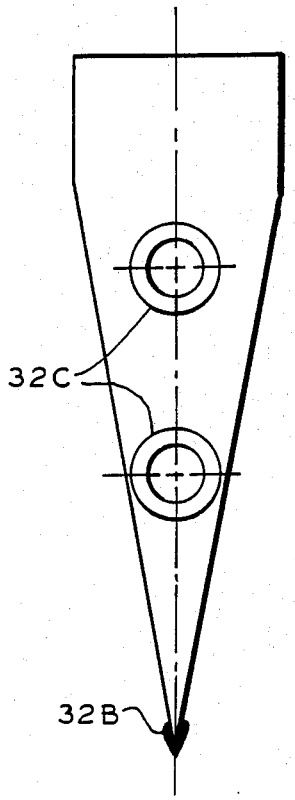
FIG. 7 is an inside view of a slit cutter which is an alternate to that of FIG. 4 in which soil is compressed rather than excavated.
Figure 8:
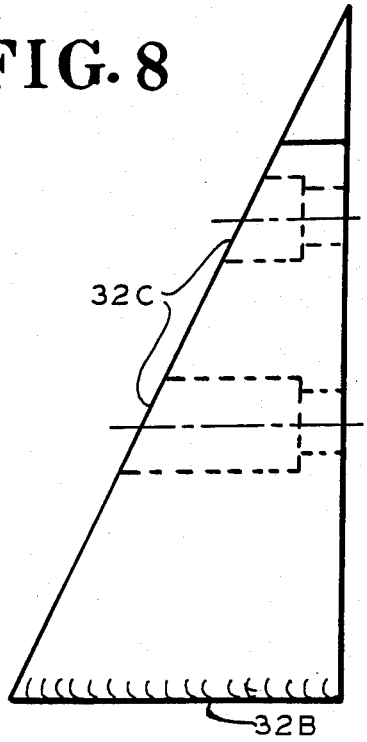
FIG. 8 is a side view of the slit cutter of FIG. 7.

An alternate slit forming device is shown in FIGS. 7, 8, and 9 as pyramidical slit former 32. Slit former 32 has three exposed triangular faces (although four is possible). Slit former 32 has mounting holes 32C for mounting to the previously described chain. If the chain is running vertically, the bottom leading edge 32B is horizontal. The side faces diverge laterally from edge 32B, reaching trailing edge 32A. Edge 32A is transverse to edge 32B and the driving direction. The remaining outer face is slanted outwardly and downwardly to intersect the edge 32B.

Slit former 32 has a shape designed not to excavate soil but to spread it and to compact it and thereby form a slit.

To facilitate an understanding of the principles of the foregoing apparatus, its operation will now be briefly described. Adavntageously, the apparatus of FIG. 1 can either be employed on a self-propelled machine (not shown) or used as a low-cost attachment to an excavator, backhoe, etc. This makes the present apparatus extremely efficient and cost effective. Alternatively, the apparatus of FIG. 1 can be attached to the mast of rammer equipment since the vertical movement of the slit trencher on the mast makes the operation of the slit trencher easier for an operator.

The slit trencher of FIG. 1 is powered by circulating the chain 4. The boom 1 may now be placed in alignment with the desired line of travel of the slit. The boom is then lowered, causing the lower end of chain 4 with its slit cutters 5 to dig into the earth. The boom 3 moves downwardly until the dozer blade 15 touches the top surface of the ground. The machine carrying boom 1 is now moved forward, thereby bringing slit formers 5 into a digging relationship with the forward end of the slit S. The boom 1 is moved along until the desired length of slit is achieved. As this occurs, the dozer blade 15 pushes the excavated soil aside so it cannot fall back into the slit. Also, the guide plate 14 stabilizes the progression of the slit cutters 5 so they do not turn to the side. As the slit S is cut, steel sheets having, for example, a 3 to 5 mm thickness but corrugated to be 5 to 10 cm thick, may be inserted into the slit S in elements having a width of 40 cm. These steel liners can be placed in parallel pairs, in some instances.

Instead of the dozer 15 and guide plate 8, or in addition thereto, there can be used an auger.

Pipe 22 can inject behind the chain, concrete or other material to fill the slit. By mounting on the slit trencher guiding device 7, one can bring into the slit the trench linings (not shown) so that the trencher can be used for trench lining work. Advantageously, the trench lining work is speeded up to about four times as compared with the known trench lining methods. Indeed the slit trencher attachment mounted on a 20-ton excavator will dig about 120 meters per hour at a 3 meter depth and width of 7–15 cm.

Occasionally, hindrances such as pipe crossings limit the production rate to half in that there can be installed trench linings on both sides of a trench in a length of 240 meters in comparison to only 50 to 60 meters reached today by known methods.

When the end of the slit S is reached, boom 1 is elevated to remove the slit trencher from slit S to complete the cutting.

It is to be appreciated that various modifications may be implemented with respect to the abovedescribed preferred embodiments. For example, the cutting edge of the slit cutter can be as long as shown in FIG. 5 (element 11) or it can be only a short cutting edge. In the latter case, the soil can also fall out off the cutter below the edge. And additionally, the slit cutter can be shaped to move the soil in one to three, or possibly more directions. On the holding bracket (6), one can also install a device for putting plastic seal breadths into the slit. For instance, by putting a roll holder for this plastic vertically above the slit and a roll in a 45-degree angle to the slit, the material can be installed. Thereafter the plastic can be unrolled and put in this way into the slit. This is a very inexpensive way of preventing groundwater or water of a channel from penetrating into areas where it is not wanted.

Obviously, many modifications and variations of the present invention are possible in light of the above teachings. It is, therefore, to be understood that within the scope of the appended claims, the invention may be practiced otherwise than as specifically described.

What is claimed is:

1. A slit trencher for mounting on a carrier machine which moves longitudinally in a driving direction, comprising:

a holding means adapted to be mounted on said carrier machine;

a boom mounted on said holding means;

a circulating means mounted on said boom to circulate thereon, said circulating means being operable to work when circulating along a running direction; and a plurality of slit formers mounted on said circulating means and each having a cutting edge slanted both laterally and longitudinally with respect to the running direction of the circulating means, said slit formers each having a rear side and each including:

(a) a cover plate-cutter combination having a horizontal width sized to cover the width of the slit, said cover plate-cutter combination being slanted in a direction outward and opposite to said running direction of said circulating means; and (b) a rear plate mounted adjacent to said cover plate-cutter combination to block the rear side, so that said cover plate-cutter combination excavates by lifting and pushing outwardly.

2. A slit trencher according to claim 1 wherein said cover plate-cutter combination has at least two slanted faces, facing in different directions.

3. A slit trencher according to claim 2 wherein said slanted faces are facing toward the right and left of said driving direction.

4. A slit trencher according to claim 3 wherein said slanted faces are at least three in number.

5. A slit trencher according to claim 2 wherein said cover plate-cutter combination has a centerline oriented along said driving direction to divide said cover plate-cutter combination into two segments sloping downwardly to the right and left.

6. A slit trencher according to claims 1, 4 or 5 further comprising:

at least one side wall affixed to one side of said slit trencher at a predetermined distance from said centerline.

7. A slit trencher according to claim 1 wherein said carrier machine is a vehicle having a multi-purpose arm, said holding means being adapted to be detachably mounted on the arm of said carrier machine.

8. A slit trencher according to claim 1 wherein said carrier machine comprises:

a self propelled vehicle for moving said slit trench in said driving direction.

9. A slit trencher according to claim 6 further comprising:

a dozer blade frontally mounted on said boom for bulldozing clear the top of the slit.

10. A slit trencher according to claims 1 2, 3, 4, 5, 7 or 8 wherein said holding means comprises:

a frame attached to said carrier machine; and a support mounted in said frame to support said boom and operable to rotate it azimuthally.

11. A slit trencher according to claim 10 wherein said frame is attached to said carrier machine to rotate said boom in elevation.

12. A slit trencher according to claims 1, 2, 3, 4, 5, 7 or 8 further comprising:

a pipe attached and parallel to said boom for injecting fluid material into said slit downstream of said boom.

13. A slit trencher according to claims 1, 2, 3, 4, 5, 7 or 8 wherein said slit can be lined with a trench lining, further comprising:

means for inserting said lining into said slit downstream of said boom.

14. A slit trencher according to claim 1 wherein said cover plate-cutter combination comprises:

a ramped portion parallel to said driving direction but tilted with respect to said running direction of said circulating means.

15. A slit trencher according to claim 14 wherein said cover plate-cutter combination comprises:

a front portion affixed to said ramped portion at an acute angle with respect to said rear plate.

16. A slit trencher according to claim 14 wherein said cover plate-cutter combination comprises:

a side portion affixed to said rear plate above said ramped portion.

17. A slit trencher according to claim 1 wherein said circulating means comprises:

a chain mounted on said boom to circulate thereon.

18. A slit trencher according to claim 1 further comprising:

means for inserting a liner into said slit downstream of said boom.

* * * * *